US009128433B2

(12) United States Patent
Sakai

(10) Patent No.: US 9,128,433 B2
(45) Date of Patent: Sep. 8, 2015

(54) FIXATION DEVICE AND IMAGE FORMATION APPARATUS

(71) Applicant: Oki Data Corporation, Tokyo (JP)

(72) Inventor: Masato Sakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/288,528

(22) Filed: May 28, 2014

(65) Prior Publication Data

US 2014/0356039 A1 Dec. 4, 2014

(30) Foreign Application Priority Data

May 29, 2013 (JP) ..... 2013-113329

(51) Int. Cl.
*G03G 15/20* (2006.01)

(52) U.S. Cl.
CPC ..... *G03G 15/2053* (2013.01); *G03G 15/2017* (2013.01); *G03G 2215/20* (2013.01); *G03G 2215/2022* (2013.01); *G03G 2215/2025* (2013.01); *G03G 2215/2029* (2013.01); *G03G 2215/2032* (2013.01); *G03G 2215/2041* (2013.01)

(58) Field of Classification Search
CPC ..... G03G 15/2017; G03G 15/2053; G03G 2215/20; G03G 2215/2022; G03G 2215/2025; G03G 2215/2029; G03G 2215/2032; G03G 2215/2041
USPC ..... 399/329
See application file for complete search history.

(56) References Cited

U.S. PATENT DOCUMENTS

| | | | | |
|---|---|---|---|---|
| 7,333,762 | B2 * | 2/2008 | Oishi et al. | 399/329 |
| 2006/0093418 | A1 * | 5/2006 | Watanabe et al. | 399/329 |
| 2007/0258741 | A1 * | 11/2007 | Kim et al. | 399/329 |

FOREIGN PATENT DOCUMENTS

JP 2013-024895 A 2/2013

* cited by examiner

*Primary Examiner* — David Gray
*Assistant Examiner* — Michael Harrison
(74) *Attorney, Agent, or Firm* — Marvin A. Motsenbocker; Mots Law, PLLC

(57) ABSTRACT

A fixation device includes a pressing member, a drive roller, an auxiliary roller, and an endless fixation belt rotatably mounted, in a loop shape, on the drive roller and the auxiliary roller. The endless fixation belt is in pressure contact with the outer peripheral surface of the pressing member, thereby forming a nip between the fixation belt and the pressing member. The drive roller is configured to drive the fixation belt to rotate in the looped shape and thereby cause the auxiliary roller to rotate due to the frictional force from an inner peripheral surface of the rotating fixation belt. A friction coefficient of a contact surface of the auxiliary roller with the fixation belt is smaller than a friction coefficient of a contact surface of the drive roller with the fixation belt.

11 Claims, 7 Drawing Sheets

FIXATION DEVICE AND IMAGE FORMATION APPARATUS

CROSS REFERENCE TO RELATED APPLICATIONS

This application claims priority based on 35 USC 119 from prior Japanese Patent Application No. 2013-113329 filed on May 29, 2013, entitled "FIXATION DEVICE AND IMAGE FORMATION APPARATUS", the entire contents of which are incorporated herein by reference.

BACKGROUND OF THE INVENTION

1. Field of the Invention

This disclosure relates to an electrophotographic image formation apparatus such as a printer, a copier, or a facsimile machine and a fixation device incorporated in the same.

2. Description of Related Art

An electrophotographic image formation process includes a series of steps, such as a charging step for forming a uniform charge on the surface of a photoreceptor, an exposing step for irradiating the surface of the photoreceptor with light to form an electrostatic latent image, a developing step for applying a charged developer to the electrostatic latent image to form a developer image on the photoreceptor, a transferring step for transferring the developer image to a medium such as a paper sheet, and a fixing step for fixing the developer image transferred onto the medium to the medium.

In the case where a powder developer is used, in the fixing step, a developer image is generally fixed to the surface of the developer on a medium by heat and pressure. Japanese Patent Application Publication No. 2013-24895 discloses a belt-heating fixation device. This fixation device includes a heated fixation belt and a pressure roller facing the fixation belt. The fixation device is configured for a paper sheet having a developer image thereon to be inserted between the fixation belt and the pressure roller and fix the developer image to the paper sheet by heat and pressure. The fixation belt is a looped endless belt, and is driven by a rotational roller member which contacts the inner surface of the fixation belt.

SUMMARY OF THE INVENTION

However, the above-described belt-heating system may degrade the image quality.

An object of an embodiment of the invention is an improved fixation device so to improve the image quality.

An aspect of the invention is a fixation device that includes a pressing member, a drive roller, an auxiliary roller, and an endless fixation belt rotatably mounted, in a loop shape, on the drive roller and the auxiliary roller. The endless fixation belt is in pressure contact with the outer peripheral surface of the pressing member, thereby forming a nip between the fixation belt and the pressing member. The drive roller is configured to drive the fixation belt to rotate in the looped shape and thereby the auxiliary roller is rotated by the frictional force from an inner peripheral surface of the rotating fixation belt. A friction coefficient of a contact surface of the auxiliary roller with the fixation belt is smaller than a friction coefficient of a contact surface of the drive roller with the fixation belt.

According to the above aspect of the invention, image quality can be improved.

DETAILED DESCRIPTION OF EMBODIMENTS

Figure 1:
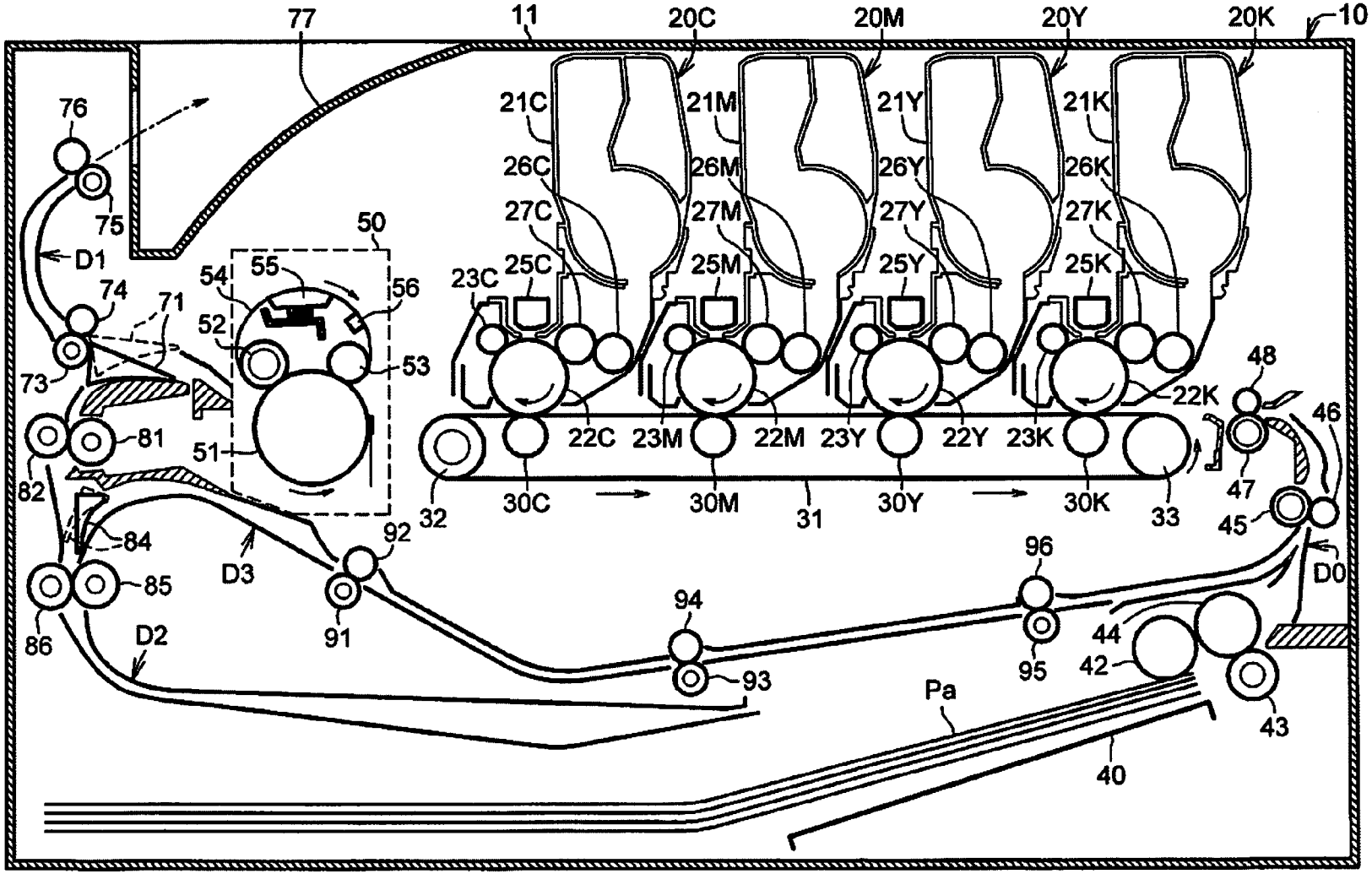
FIG. 1 is a view schematically illustrating an example of an image formation apparatus of a first embodiment.

Descriptions are provided hereinbelow for embodiments based on the drawings. In the respective drawings referenced herein, the same constituents are designated by the same reference numerals and any duplicate explanation concerning the same constituents is omitted. All of the drawings are provided to illustrate the respective examples only.

Hereinafter, various embodiments according to the invention are described with reference to the drawings.

First Embodiment

FIG. 1 is a view schematically illustrating an example of image formation apparatus 10 of a first embodiment. As illustrated in FIG. 1, image formation apparatus 10 includes, within casing 11, medium housing cassette 40 configured to house record media Pa in the form of a sheet as a material to which an image is transferred, pickup roller 42 configured to pick up record medium Pa from medium housing cassette 40, a pair of feed roller 44 and retardant roller 43 configured to send out record media Pa one by one, and transport rollers 45 and 46 and registration rollers 47 and 48 configured to transport the sent out record media Pa.

Medium housing cassette 40 has the function of housing a stack of record media Pa, and is detachably installed in image formation apparatus 10. Record medium Pa is a material in the form of a sheet such as paper, plastic film, synthetic paper, or cloth. Pickup roller 42 is configured to rotate counterclockwise to pick up record medium Pa from medium housing cassette 40. Feed roller 44 and retardant roller 43 can pinch the record media Pa picked up from medium housing cassette 40 and feed record medium Pa singly into feed path D0.

Moreover, image formation apparatus 10 includes image formation units 20K, 20Y, 20M, and 20C respectively configured to generate developer images of black (K), yellow (Y), magenta (M), and cyan (C), and toner cartridges (developer containers) 21K, 21Y, 21M, and 21C respectively detachably attached to casings of image formation units 20K, 20Y, 20M, and 20C. Toner cartridges 21K, 21Y, 21M, and 21C contain black (K), yellow (Y), magenta (M), and cyan (C) developers, respectively.

Further, image formation apparatus 10 includes conveyor belt 31 configured in the form of an endless belt, drive roller 32 configured to drive conveyor belt 31, driven roller 33 driven by conveyor belt 31, and transfer rollers 30K, 30Y, 30M, and 30C respectively disposed to face image formation units 20K, 20Y, 20M, and 20C across conveyor belt 31. As illustrated in FIG. 1, conveyor belt 31 is passed over drive roller 32 and driven roller 33 and is stretched therebetween.

Image formation units 20K, 20Y, 20M, and 20C are aligned in the direction of travel of conveyor belt 31 directly on conveyor belt 31, and arranged in series from an upstream side to a downstream side in the medium transport direction. Drive roller 32 receives power transmitted from an unillustrated drive source to rotate counterclockwise, thus being capable of moving conveyor belt 31. Accordingly, record medium Pa mounted on conveyor belt 31 passes directly under image formation units 20K, 20Y, 20M, and 20C in that order.

Image formation units 20K, 20Y, 20M, and 20C are respectively disposed at positions facing transfer rollers 30K, 30Y, 30M, and 30C across conveyor belt 31. Developer images formed by image formation units 20K, 20Y, 20M, and 20C are sequentially transferred to record medium Pa on conveyor belt 31 with a predetermined timing as conveyor belt 31 rotates. Thus, a developer image is formed on record medium Pa.

Image formation unit 20K configured to form a black developer image includes photosensitive drum 22K, charging roller 23K configured to uniformly charge the surface of photosensitive drum 22K, LED head (exposure unit) 25K configured to perform an exposure for the formation of an electrostatic latent image on the surface of photosensitive drum 22K, development roller 27K serving as a developer support, and supply roller 26K configured to supply development roller 27K with a black developer supplied from toner cartridge 21K. Image formation unit 20K further includes a development blade (not illustrated) configured to apply a thin developer layer on the surface of development roller 27K. When a portion of the surface of photosensitive drum 22K in which the electrostatic latent image is formed reaches development roller 27K, the developer is moved to the surface of photosensitive drum 22K by the potential difference between the electrostatic latent image on photosensitive drum 22K and development roller 27K to form a developer image on photosensitive drum 22K. After that, the developer image on photosensitive drum 22K is transferred onto record medium Pa by transfer roller 30K. At this time, the developer is transferred onto record medium Pa nipped (gripped) between transfer roller 30K and photosensitive drum 22K by a transfer bias voltage applied to transfer roller 30K.

The other image formation units 20Y, 20M, and 20C also have configurations similar to that of image formation unit 20K except for the type of developer. Specifically, image formation unit 20Y configured to form a yellow developer image includes photosensitive drum 22Y, charging roller 23Y configured to uniformly charge the surface of photosensitive drum 22K, LED head (exposure unit) 25Y configured to expose the surface of photosensitive drum 22Y, development roller 27Y serving as a developer support, and supply roller 26Y configured to supply development roller 27Y with a yellow developer supplied from toner cartridge 21Y. Moreover, image formation unit 20M configured to form a magenta developer image includes photosensitive drum 22M, charging roller 23M configured to uniformly charge the surface of photosensitive drum 22M, LED head (exposure unit) 25M configured to expose the surface of photosensitive drum 22M, development roller 27M serving as a developer support, and supply roller 26M configured to supply development roller 27M with a magenta developer supplied from toner cartridge 21M. Further, image formation unit 20C configured to form a cyan developer image includes photosensitive drum 22C, charging roller 23C configured to uniformly charge the surface of photosensitive drum 22C, LED head (exposure unit) 25C configured to expose the surface of photosensitive drum 22C, development roller 27C serving as a developer support, and supply roller 26C configured to supply development roller 27C with a cyan developer supplied from toner cartridge 21C.

It should be noted that each of photosensitive drums 22K, 22Y, 22M, and 22C includes, for example, a metallic pipe (electrically conductive substrate) made of aluminum or the like and a photoconductive layer formed around the metallic pipe and made of an organic photoreceptor (OPC: Organic Photoconductor) or the like.

Conveyor belt 31 feeds record medium Pa carrying a developer image made of an unfixed developer on the surface thereof into fixation device 50 disposed downstream thereof. Fixation device 50 applies pressure and heat to the developer image transferred onto record medium Pa to melt the developer image and fix the developer image to record medium Pa.

Record medium Pa sent from fixation device 50 is fed to either a pair of transport rollers 73 and 74 or a pair of switchback transport rollers 81 and 82 in accordance with the orientation of separator 71. In the case where image formation apparatus 10 operates in a simplex print mode, separator 71 has a normal orientation indicated by solid lines in FIG. 1, and guides record medium Pa sent from fixation device 50 to transport rollers 73 and 74. At this time, transport rollers 73 and 74 feed the guided record medium Pa into discharge path D1. Discharge rollers 75 and 76 discharge record medium Pa on discharge path D1 to paper output tray 77 of image formation apparatus 10.

On the other hand, in the case where image formation apparatus 10 operates in a duplex print mode, the orientation of separator 71 is switched to a switchback orientation indicated by dotted lines in FIG. 1. At this time, switchback transport rollers 81 and 82 send record medium Pa, guided by separator 71, to another separator 84. This separator 84 has an orientation indicated by solid lines in FIG. 1 and guides record medium Pa to a pair of transport rollers 85 and 86. These transport rollers 85 and 86 transport the leading edge of the guided record medium Pa to transport path D2 in a lower portion of image formation apparatus 10, and then reverses the direction of transport of record medium Pa. At this time, the orientation of separator 84 is switched from the orientation indicated by solid lines in FIG. 1 to the orientation indicated by dotted lines therein. Accordingly, separator 84 guides the trailing edge of record medium Pa to transport path D3 of a switchback transport system. After that, transport rollers 91, 92, 93, 94, 95, and 96, constituting the switchback transport system, transport record medium Pa back to feed path D0. Then, transport rollers 45 and 46 and registration rollers 47 and 48 transport record medium Pa to conveyor belt 31. Image formation units 20K, 20Y, 20M, and 20C form developer images on the back side of the re-fed record medium Pa.

Next, fixation device 50 of this embodiment is described.

Figure 2:
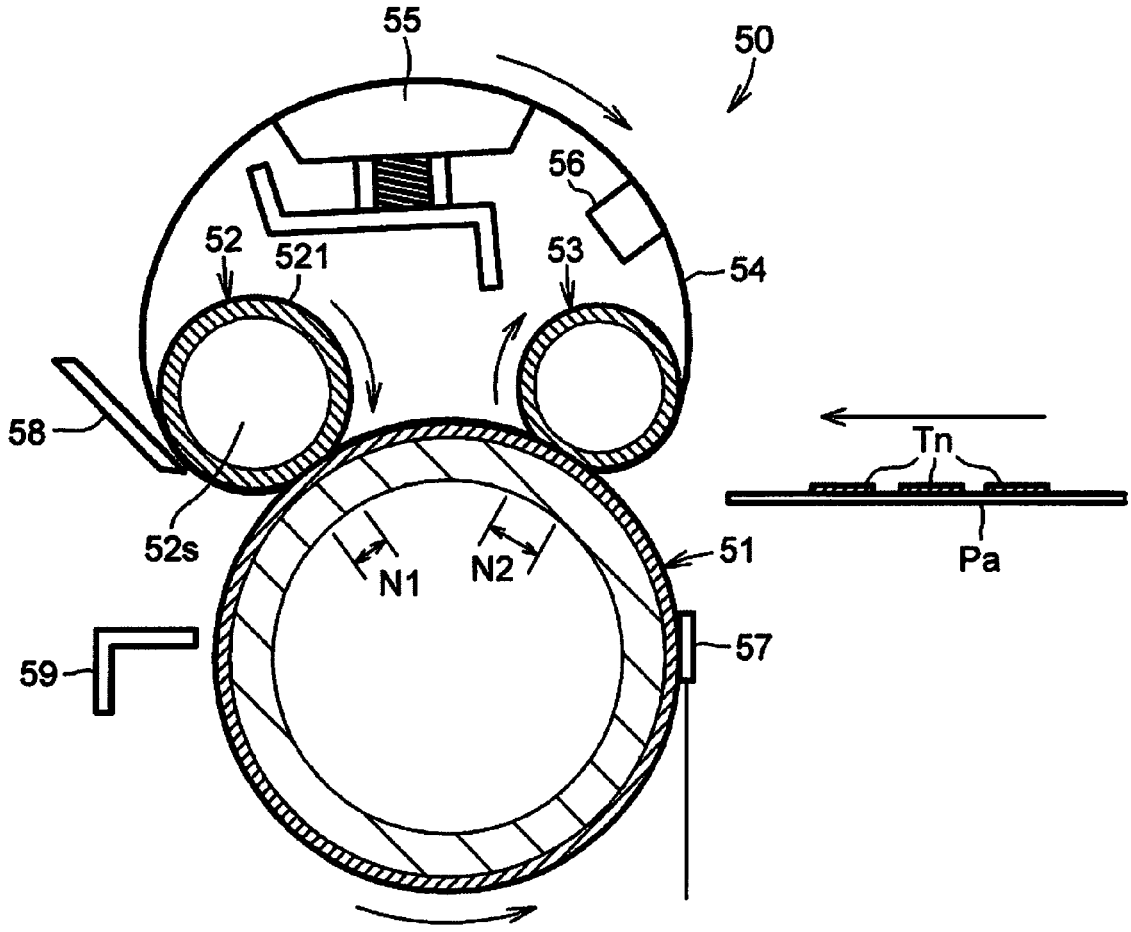
FIG. 2 is a view schematically illustrating a cross-sectional configuration of a principal part of a fixation device of the first embodiment.
Figure 3:
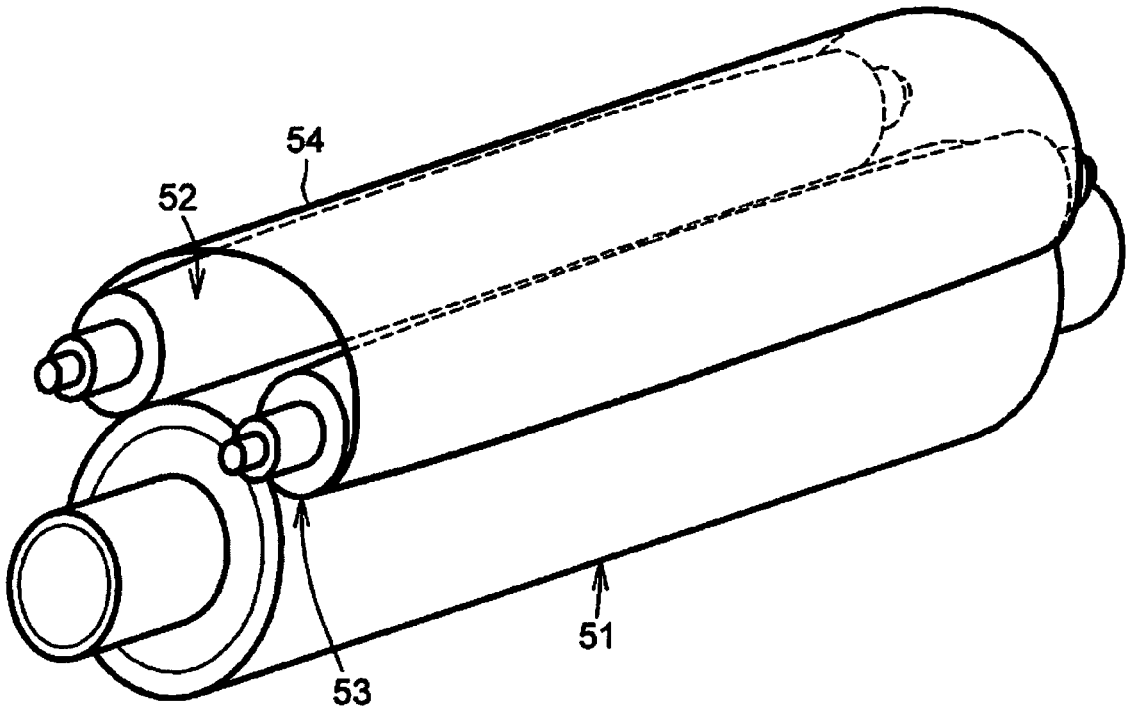
FIG. 3 is a perspective view schematically illustrating the arrangement of a pressure roller, a drive roller, an auxiliary roller, and a fixation belt.

FIG. 2 is a view schematically illustrating a cross-sectional configuration of a principal part of fixation device 50. As illustrated in FIG. 2, fixation device 50 includes pressing member (pressure roller) 51 in the form of a roller, drive roller 52 and auxiliary roller 53 disposed to face the outer peripheral surface of pressure roller 51, endless fixation belt 54 which is passed over drive roller 52 and auxiliary roller 53 and is in pressure contact with the surface of pressure roller 51, and heater member 55 configured to support and heat fixation belt 54. Heater member 55 is disposed within looped fixation belt 54 to support fixation belt 54 in a stretched state. FIG. 3 is a perspective view schematically illustrating the arrangement of pressure roller 51, drive roller 52, auxiliary roller 53, and fixation belt 54.

Pressure roller 51 and fixation belt 54 apply pressure and heat to record medium Pa, which is fed into a nip between pressure roller 51 and fixation belt 54, to fix developer image Tn to record medium Pa. As heater member 55, for example, a heat source such as a halogen lamp may be used.

Drive roller 52 is disposed within looped fixation belt 54 and spring-biased toward the outer peripheral surface of pressure roller 51. Accordingly, between pressure roller 51 and drive roller 52, fixation belt 54 is pressed against the outer peripheral surface of pressure roller 51 to form nip N1 with a certain width. Drive roller 52 receives a rotational driving force transmitted from an unillustrated drive motor and rotates clockwise. This causes fixation belt 54 to rotate clockwise in a looped shape.

Drive roller 52 includes metal core 52s made of iron, SUS, or the like as a shaft portion, and further includes rubbery or spongy elastic resin layer 521 on the outer peripheral surface of core 52s. Elastic resin layer 521 is made of a nonconductive or conductive material. A conductive coating film is applied to an upper surface of elastic resin layer 521. Drive roller 52 needs to rotate fixation belt 54, and therefore elastic resin layer 521 desirably has a friction coefficient not less than a predetermined friction coefficient. This can reduce the occurrence of a slip between drive roller 52 and fixation belt 54.

On the other hand, auxiliary roller 53 is disposed upstream of drive roller 52 in the direction of rotation of fixation belt 54 and within looped fixation belt 54. Moreover, auxiliary roller 53 is also spring-biased toward the outer peripheral surface of pressure roller 51. Accordingly, between pressure roller 51 and auxiliary roller 53, fixation belt 54 is pressed against the outer peripheral surface of pressure roller 51 to form nip N2 with a certain width. Auxiliary roller 53 receives frictional force from the inner peripheral surface of fixation belt 54 and rotates clockwise as a driven roller.

The outermost layer of auxiliary roller 53 is configured such that the friction coefficient μ1 of the contact surface of auxiliary roller 53 with fixation belt 54 is smaller than the friction coefficient μ2 of the contact surface of drive roller 52 with fixation belt 54.

Figure 4A:
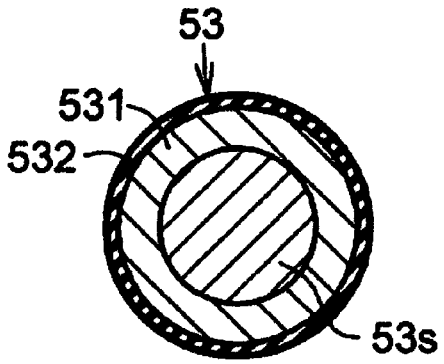
FIGS. 4A, 4B, and 4C are views schematically illustrating examples of a cross-sectional configuration of the auxiliary roller.

FIG. 4A is a view schematically illustrating one example of a cross-sectional configuration of auxiliary roller 53. As illustrated in FIG. 4A, auxiliary roller 53 includes metal core 53s made of iron, SUS, or the like as a shaft portion, and further includes a rubbery or spongy elastic resin layer 531 on the outer peripheral surface of core 53s. Elastic resin layer 531 is made of an electrically conductive material. Moreover, electrically conductive coating film 532 is applied to an upper surface of elastic resin layer 531.

Coating film 532 constituting the outermost layer of auxiliary roller 53 can be formed using a solid lubricant such as graphite, PTFE (polytetrafluoroethylene: Teflon (registered trademark)), or the like. This can make the friction coefficient μ1 of the outermost layer of auxiliary roller 53 smaller than the friction coefficient μ2 of the outermost layer of drive roller 52.

Figure 4B:
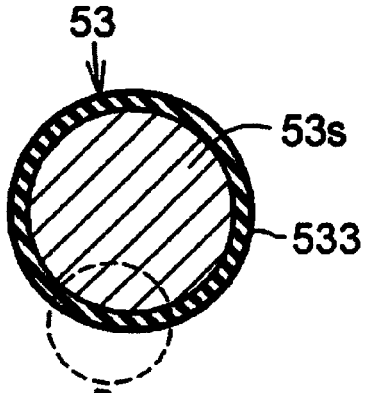
Figure 4C:
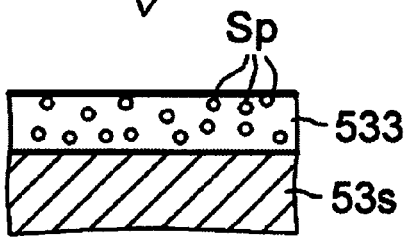

FIG. 4B is a view schematically illustrating another example of the cross-sectional configuration of auxiliary roller 53. As illustrated in FIG. 4B, auxiliary roller 53 includes metal core 53s made of iron, SUS, or the like as a shaft portion, and further includes a rubbery and spongy elastic resin layer 533 on the outer peripheral surface of core 53s. As illustrated in FIG. 4C, fine grains Sp of fluorocarbon resin, silica, or the like are dispersedly added to elastic resin layer 533 to impart slidability to the outermost layer of auxiliary roller 53. This can make the friction coefficient μ1 of the outermost layer of auxiliary roller 53 smaller than the friction coefficient μ2 of the outermost layer of drive roller 52.

The outer peripheral surfaces of drive roller 52 and auxiliary roller 53 are curved surfaces having crowned shapes. A crowned shape means a shape with an outside diameter gradually increasing from two opposite end portions toward a central portion in the longitudinal direction (axial direction) of the roller. The crowned shapes can make the contact pressure on the outer peripheral surface of the roller uniform in the longitudinal direction thereof.

Figure 5A:
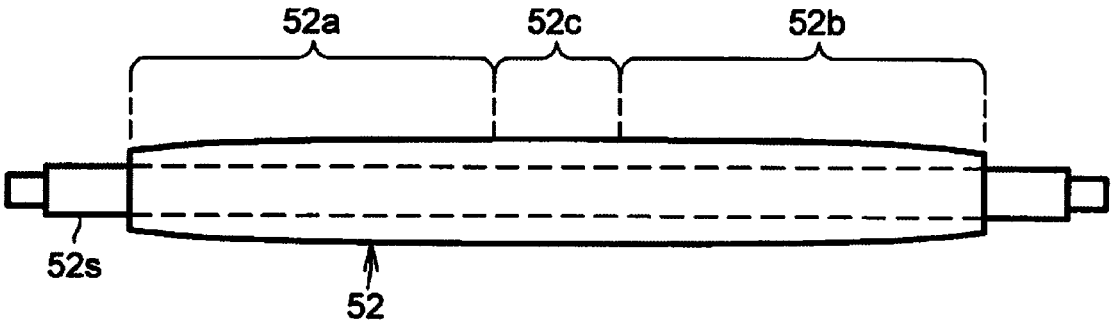
FIG. 5A is a view schematically illustrating one example of a side shape of the drive roller.
Figure 5B:
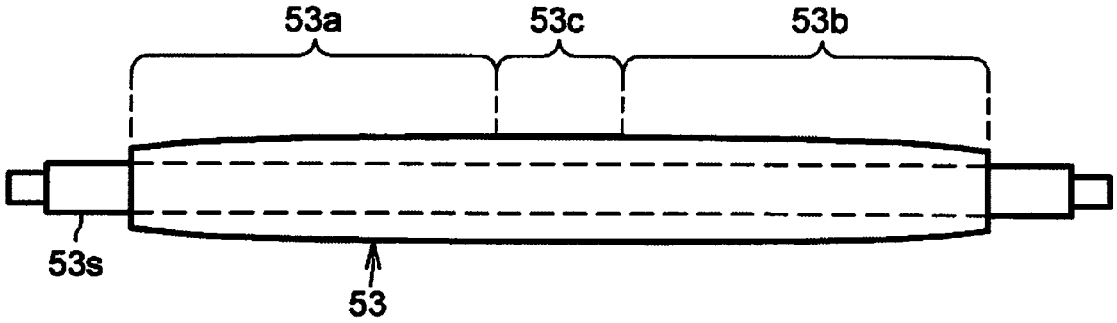
FIG. 5B is a view schematically illustrating one example of a side shape of the auxiliary roller.

FIG. 5A is a view schematically illustrating one example of a side shape of drive roller 52, and FIG. 5B is a view schematically illustrating one example of a side shape of auxiliary roller 53. As illustrated in FIG. 5A, drive roller 52 includes central portion 52*c* with an outer peripheral surface which is level in the longitudinal direction (axial direction) and tapered portions 52*a* and 52*b* with outside diameters gradually decreasing from central portion 52*c* to the end portions. On the other hand, as illustrated in FIG. 5B, similar to drive roller 52, auxiliary roller 53 also includes central portion 53*c* with an outer peripheral surface which is level in the longitudinal direction (axial direction) and tapered portions 53*a* and 53*b* with outside diameters gradually decreasing from central portion 53*c* to the end portions. In the case of drive roller 52, the outside diameter difference between central portion 52*c* and each of the two end portions (outer end portions of tapered portions 52*a* and 52*b*) can be, for example, approximately 0.3 mm to 1.0 mm. Similarly, in the case of auxiliary roller 53, the outside diameter difference between central portion 53*c* and each of the two end portions (outer end portions of tapered portions 53*a* and 53*b*) can be, for example, approximately 0.3 mm to 1.0 mm.

Fixation belt 54 illustrated in FIG. 2 can be fabricated by, for example, forming an elastic layer made of silicone rubber or the like on a base-material film made of a heat-resistant resin such as polyimide, and forming a release layer made of a fluoropolymer or the like on the elastic layer. In that case, the release layer constitutes the outer peripheral surface of fixation belt 54, and the base-material film constitutes the inner peripheral surface of fixation belt 54.

The temperature of fixation belt 54 is detected by temperature sensor 56, such as a thermistor, and the surface temperature of pressure roller 51 is also detected by temperature sensor 57, such as a thermistor. Based on the results of detection by temperature sensors 56 and 57, a control unit (not illustrated) such as a microprocessor can control the temperature generated by heater member 55 and maintain the temperature of fixation belt 54 within a desired range.

Record medium Pa, sent from the nip between fixation belt 54 and pressure roller 51, is guided by guide rib 58 and separation guide 59. Guide rib 58 and separation guide 59 are disposed downstream of nip N1 in the direction of transport of record medium Pa. Guide rib 58 is disposed on a side which the side of record medium Pa carrying developer image Tn faces, and separation guide 59 is disposed on a side which the side of record medium Pa not carrying developer image Tn faces. Guide rib 58 and separation guide 59 have the function of smoothly guiding record medium Pa which has passed nip N1 so that record medium Pa may be prevented from wrapping around fixation belt 54 or pressure roller 51.

Next, the operation of the above-described fixation device 50 is described.

During the print operation of image formation apparatus 10, fixation belt 54 is rotated by the rotational driving force of drive roller 52. As fixation belt 54 rotates, auxiliary roller 53 also starts rotating as a driven roller. Moreover, heater member 55 supplied with electric power generates heat and heats fixation belt 54. The control unit detects the surface temperature of fixation belt 54 from a detection output of temperature sensor 56, and controls the amount of heat generated by heater member 55 based on the detection result. This makes it possible to maintain the surface temperature of fixation belt 54 at a proper temperature.

When record medium Pa to which the developer image has been transferred passes nip portions N1 and N2, developer image Tn on record medium Pa is fixed to record medium Pa. Then, record medium Pa is guided downstream by guide rib 58 and separation guide 59.

Since the outermost layer of drive roller 52 has a crowned shape, the rotational peripheral velocity thereof varies along the axis thereof during the rotation of drive roller 52. As a result (due to the rotational speed difference), triboelectric charging occurs between the outer peripheral surface of drive roller 52 and the inner peripheral surface of fixation belt 54. Moreover, since the outermost layer of auxiliary roller 53 also has a crowned shape, the rotational peripheral velocity thereof varies along the axis thereof when auxiliary roller 53 rotates as a driven roller. As a result (due to the rotational speed difference), triboelectric charging also occurs between the outer peripheral surface of auxiliary roller 53 and the inner peripheral surface of fixation belt 54.

Such triboelectric charging of fixation belt 54 may cause an impaired image quality of a fixed developer image.

Figure 6A:
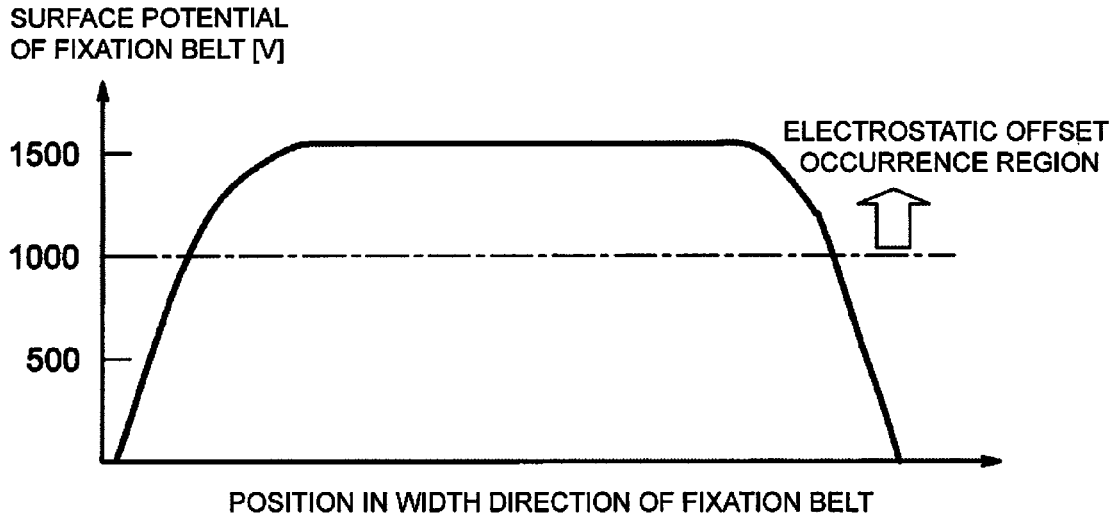
FIGS. 6A and 6B are graphs illustrating measured values of the surface potential of the fixation belt.
Figure 6B:
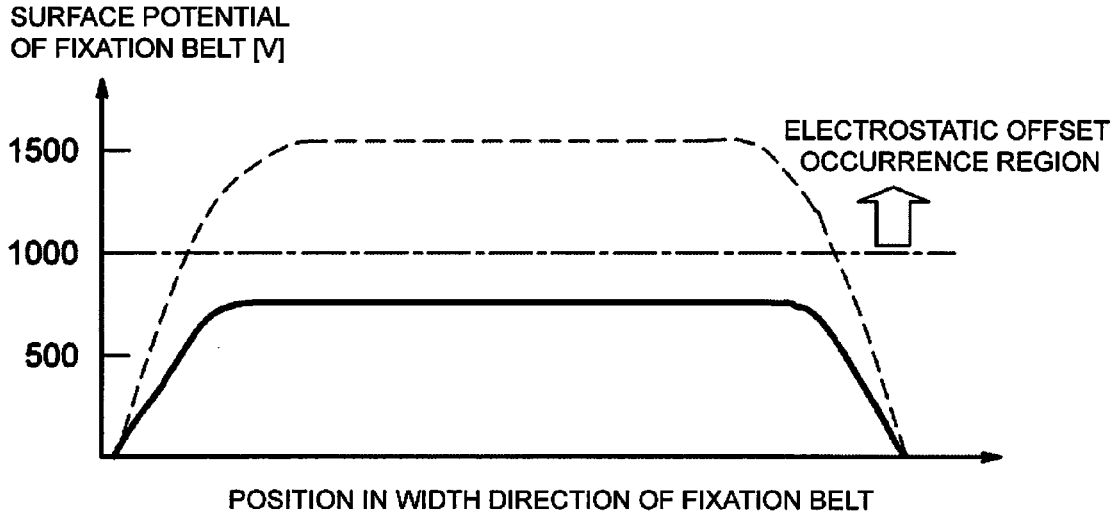

FIG. 6A is a graph illustrating measured values of the surface potential of fixation belt 54 obtained during a test operation of fixation device 50 in the case where the friction coefficient $\mu 2$ of drive roller 52 and the friction coefficient $\mu 1$ of auxiliary roller 53 are equal ($\mu 1=\mu 2$). On the other hand, FIG. 6B is a graph illustrating measured values of the surface potential of fixation belt 54 obtained during a test operation of fixation device 50 in the case where the friction coefficient $\mu 1$ of auxiliary roller 53 is smaller than the friction coefficient $\mu 2$ of drive roller 52 ($\mu 1<\mu 2$). The vertical axis of each of the graphs in FIGS. 6A and 6B represents surface potential (unit: volts), and the horizontal axis of each of the graphs represents position in the width direction of fixation belt 54 (axial direction of drive roller 52). The surface potential of fixation belt 54 is measured with a 10-mm pitch. Moreover, a slidable coating film is used as the outermost layer of auxiliary roller 53.

The result of the measurements in FIG. 6B is obtained under the following conditions: with regard to the friction coefficient $\mu 2$ of the outermost layer of drive roller 52, both of the dynamic friction coefficient and the static friction coefficient are within the range of 0.6 to 0.8; and with regard to the friction coefficient $\mu 1$ of the outermost layer of auxiliary roller 53, both of the dynamic friction coefficient and the static friction coefficient are within the range of 0.2 to 0.4. The measurement of the friction coefficient $\mu 2$ is performed using a test specimen of SUS balls and a surface voltage measuring instrument marketed under the brand name HEIDON. A load of 200 g is placed on the test specimen. The distance of measurement is 50 mm. The speed of the test specimen is 600 mm/min. On the other hand, the measurement of the friction coefficient $\mu 1$ is also performed using a test specimen of SUS balls and a surface voltage measuring instrument marketed under the brand name HEIDON. A load of 200 g is placed on the test specimen. The distance of measurement is 50 mm. The speed of the test specimen is 600 mm/min.

As can be seen from FIG. 6A, in the case where the friction coefficients $\mu 1$ and $\mu 2$ are equal, the surface potential is +1500 volt. When toner transferred to record medium Pa is fixed in that state, the toner causes an offset (electrostatic offset) in which toner is transferred to the surface of fixation belt 54 to disturb a subsequent image because the polarity of the toner itself is a negative polarity. It should be noted that an electrostatic offset is considered to occur as follows: for example, when record medium Pa having toner on the surface thereof enters the fixation device, the toner on record medium Pa is moved by electrostatic forces due to a charge unevenness (spatial charge bias) and the like on the surfaces of fixation belt 54 and pressure roller 51. For example, the negatively charged toner on record medium Pa may adhere to fixation belt 54 which is positively charged, or the negatively charged toner may move due to the repulsion between negatively charged toner and a negatively charged member nearby.

On the other hand, in the case of FIG. 6B, it can be seen that the surface potential decreases, and that the amount of triboelectric charging on fixation belt 54 reduces. Thus, it is confirmed that an electrostatic offset is prevented.

As described above, the first embodiment is configured such that the friction coefficient $\mu 1$ of auxiliary roller 53 is smaller than the friction coefficient $\mu 2$ of drive roller 52. This can reduce triboelectric charging between auxiliary roller 53 and the inner peripheral surface of fixation belt 54. Accordingly, the surface potential of fixation belt 54 can be lowered, and an electrostatic offset can be prevented.

Second Embodiment

Next, a second embodiment according to the invention is described. The configuration of an image formation apparatus of this embodiment is the same as the configuration of image formation apparatus 10 of the above-described first embodiment, except that a different fixation device is employed. Moreover, the configuration of a fixation device of this embodiment is the same as the configuration of fixation device 50 of the above-described first embodiment, except that a different auxiliary roller is employed.

Figure 7:
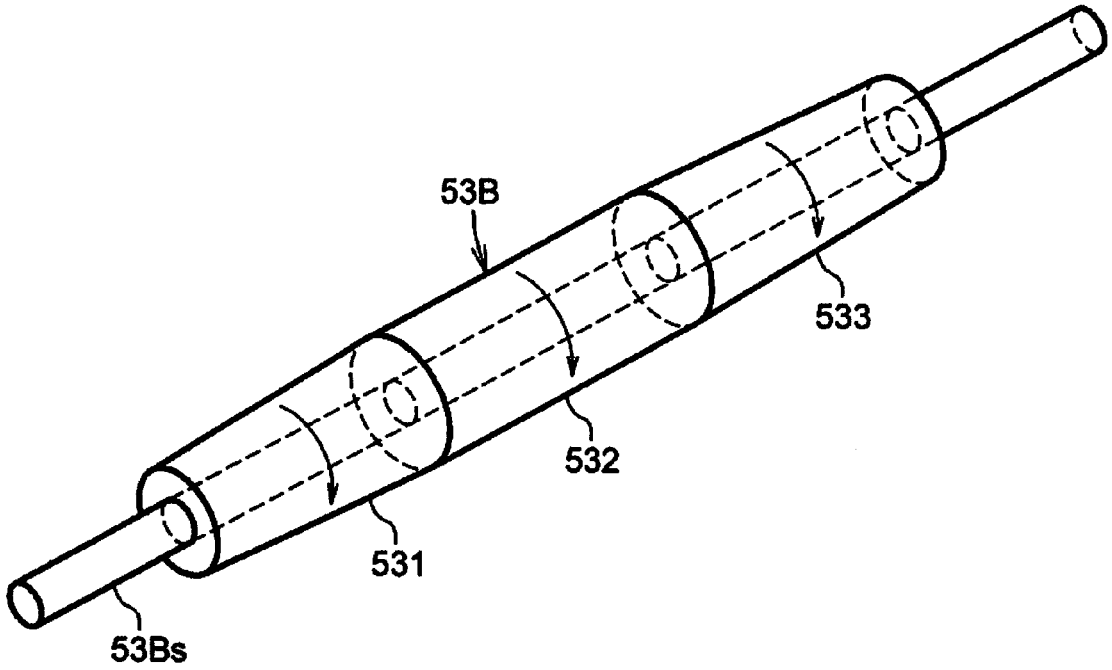
FIG. 7 is a perspective view schematically illustrating the configuration of auxiliary roller 53B of a second embodiment.

FIG. 7 is a perspective view schematically illustrating the configuration of auxiliary roller 53B of the second embodiment. As illustrated in FIG. 7, auxiliary roller 53B includes rotary members (rollers) 531, 532, and 533 coaxially arranged along the longitudinal direction of auxiliary roller 53B. The set of rotary members 531, 532, and 533 constitutes one roller in a crowned shape as a whole. The cross-sectional configuration of each of rotary members 531, 532, and 533 is the same as the cross-sectional configuration of auxiliary roller 53 of the above-described first embodiment. Rotary members 531, 532, and 533 are rotatably attached to shaft portion 53Bs. Accordingly, rotary members 531, 532, and 533 contact the inner peripheral surface of fixation belt 54, and can rotate independently from each other by a frictional force from the inner peripheral surface of fixation belt 54.

When fixation belt 54 starts rotating, auxiliary roller 53B starts rotating by frictional force from the inner peripheral surface of fixation belt 54. Since the elastic resin layer constituting the outermost layer of auxiliary roller 53B is divided into rotary members (rollers) 531 to 533, the rotational speeds of rollers 531 to 533 contacting fixation belt 54 are different from each other in the axial direction of auxiliary roller 53B. The inner peripheral surface of fixation belt 54 and rollers 531 to 533 reduce the occurrence of peripheral velocity difference during rotation. Accordingly, charging due to friction can be reduced.

As described above, the second embodiment makes it possible to reduce the peripheral velocity difference between each of the rotary members 531 to 533 of auxiliary roller 53B and the inner peripheral surface of fixation belt 54. Accordingly, triboelectric charging between auxiliary roller 53B and the inner peripheral surface of fixation belt 54 can be reduced. Thus, the amount of charging on the surface of fixation belt 54 decreases, and the occurrence of an electrostatic offset can be reduced.

While various embodiments according to the invention have been described above with reference to the drawings, those are illustrative examples of the invention, and various modes other than the above-described ones can also be employed. For example, the invention can be applied not only to a printer but also to a copier, a facsimile machine, or an MFP (Multi Function Peripheral). It should be noted that an MFP is a multi-function image formation apparatus serving as a copier, a printer, an image scanner, a facsimile machine, and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation device for fixing a developer image on a medium to the medium, comprising:

a pressing member;

a drive roller disposed to face a portion of an outer peripheral surface of the pressing member, with an endless fixation belt between the drive roller and the pressing member;

an auxiliary roller disposed to face another portion of the outer peripheral surface of the pressing member, with the endless fixation belt between the auxiliary roller and the pressing member; and the endless fixation belt rotatably mounted, in a loop shape, on the drive roller and the auxiliary roller, and being in pressure contact with the outer peripheral surface of the pressing member thereby forming a nip between the fixation belt and the pressing member, wherein the pressing member is configured to apply pressure to the medium fed into the nip between the pressing member and the fixation belt, the drive roller is configured to drive the fixation belt to rotate in the looped shape, thereby causing the auxiliary roller to become rotated by a frictional force from an inner peripheral surface of the rotating fixation belt, a friction coefficient of a contact surface of the auxiliary roller with the fixation belt is smaller than a friction coefficient of a contact surface of the drive roller with the fixation belt, and the outermost layer of the auxiliary roller comprises a coating film formed on a layer underlying the outermost layer.

2. The fixation device according to claim 1, wherein the auxiliary roller is disposed upstream of the drive roller in a direction of rotation of the fixation belt.

3. The fixation device according to claim 1, wherein an outermost layer of the drive roller comprises an elastic layer, and an outermost layer of the auxiliary roller comprises an elastic layer.

4. The fixation device according to claim 3, wherein the outermost layer of the auxiliary roller comprises an elastic resin layer with fine grains dispersedly added thereto.

5. The fixation device according to claim 1, wherein the auxiliary roller comprises rotary members coaxially arranged along the axial direction of the auxiliary roller, and the rotary members are in contact with the inner peripheral surface of the fixation belt, and are rotatable independently from each other by frictional force from the inner peripheral surface of the fixation belt.

6. The fixation device according to claim 1, wherein the auxiliary roller is in a crowned shape with an outside diameter gradually increasing from two opposite end portions to a central portion in a longitudinal direction of the auxiliary roller.

7. An image formation apparatus comprising:

an image formation section configured to form a developer image corresponding to image data;

a transfer section configured to transfer the developer image onto a medium; and the fixation device according to claim 1, configured to fix the transferred developer image to the medium.

8. The image formation apparatus according to claim 7, wherein the image formation section is configured to electrophotographically form the developer image.

9. The fixation device according to claim 1, further comprising a heater wherein the drive roller, the auxiliary roller, and the heater are provided interior of the endless fixation belt and are in contact with the inner peripheral surface of the endless fixation belt such that the heater is in contact with the inner peripheral surface of the endless fixation belt at a position other than the nip.

10. The fixation device according to claim 1, wherein a diameter of the auxiliary roller is greater than a diameter of the drive roller.

11. The fixation device according to claim 1, wherein the nip between the fixation belt and the pressing member includes a first nip portion corresponding to a first position between the drive roller and the pressing member and a second nip portion corresponding to a second position between the auxiliary roller and the pressing member, and the pressure of the auxiliary roller against the pressing member is greater than the pressure of the drive roller against the pressing member such that the second nip portion between the auxiliary roller and the pressing member is larger than the first nip portion between the drive roller and the pressing member.

* * * * *